US009933732B2

(12) United States Patent
Itoh et al.

(10) Patent No.: US 9,933,732 B2
(45) Date of Patent: Apr. 3, 2018

(54) FIXING DEVICE AND IMAGE FORMING APPARATUS

(71) Applicant: FUJI XEROX CO., LTD., Tokyo (JP)

(72) Inventors: Kazuyoshi Itoh, Kanagawa (JP); Yasuhiro Uehara, Kanagawa (JP); Kiyoshi Koyanagi, Kanagawa (JP); Toru Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/338,799

(22) Filed: Oct. 31, 2016

(65) Prior Publication Data

US 2017/0343933 A1 Nov. 30, 2017

(30) Foreign Application Priority Data

May 24, 2016 (JP) ..... 2016-103613

(51) Int. Cl.
*G03G 15/20* (2006.01)
*G03G 15/00* (2006.01)

(52) U.S. Cl.
CPC ..... *G03G 15/205* (2013.01); *G03G 15/2039* (2013.01); *G03G 15/2053* (2013.01); *G03G 15/2078* (2013.01); *G03G 15/5004* (2013.01); *G03G 15/5012* (2013.01); *G03G 2215/2032* (2013.01)

(58) Field of Classification Search
CPC ..... G03G 15/2039; G03G 15/205; G03G 15/2053; G03G 15/2078; G03G 15/50; G03G 15/5004; G03G 15/5012; G03G 2215/2032
USPC ..... 399/33, 69, 329
See application file for complete search history.

(56) References Cited

U.S. PATENT DOCUMENTS

2007/0183798 A1* 8/2007 Moriguchi ..... G03G 15/2039 399/33
2010/0178071 A1* 7/2010 Barton ..... G03G 15/2039 399/69

(Continued)

FOREIGN PATENT DOCUMENTS

JP 2000-259037 A 9/2000
JP 2002-110313 A 4/2002
JP 2004-22486 A 1/2004

*Primary Examiner* — Benjamin Schmitt
(74) *Attorney, Agent, or Firm* — Sughrue Mion, PLLC

(57) ABSTRACT

A fixing device includes: a tubular member extending in an axial direction and supported so as to be rotatable; a heat-generating member extending in the axial direction and in contact with an area between one end and the other end of the tubular member, the heat-generating member generating heat to heat the tubular member by receiving voltage; a pressure member that presses, to an outer circumferential surface of the tubular member, a recording medium having a toner image transferred thereto; and an interrupting member disposed between another portion of the heat-generating member and the tubular member and extending in the axial direction, the interrupting member being in contact with an area between one end and the other end of the heat-generating member and interrupting the voltage applied to the heat-generating member when at least a portion in contact with the heat-generating member reaches or exceeds a threshold temperature.

11 Claims, 5 Drawing Sheets

(56) References Cited

U.S. PATENT DOCUMENTS

2011/0064440 A1* 3/2011 Saitoh ..... G03G 15/2042
399/69
2013/0302046 A1* 11/2013 Monde ..... G03G 15/205
399/33

* cited by examiner

FIXING DEVICE AND IMAGE FORMING APPARATUS

CROSS-REFERENCE TO RELATED APPLICATIONS

This application is based on and claims priority under 35 USC 119 from Japanese Patent Application No. 2016-103613 filed May 24, 2016.

BACKGROUND

Technical Field

The present invention relates to fixing devices and image forming apparatuses.

SUMMARY

According to an aspect of the invention, there is provided a fixing device including: a tubular member extending in an axial direction and supported so as to be able to rotate; a heat-generating member extending in the axial direction and in contact with an area between one end portion and the other end portion of the tubular member, the heat-generating member generating heat to heat the tubular member by receiving voltage; a pressure member that nips the tubular member between the pressure member and a portion of the heat-generating member and presses, to an outer circumferential surface of the tubular member, a recording medium having a toner image transferred thereto and being transported; and an interrupting member disposed between another portion of the heat-generating member and the tubular member and extending in the axial direction, the interrupting member being in contact with an area between one end portion and the other end portion of the heat-generating member and interrupting the voltage applied to the heat-generating member when at least a portion of the part in contact with the heat-generating member in the axial direction reaches or exceeds a threshold temperature.

BRIEF DESCRIPTION OF THE DRAWINGS

Exemplary embodiment of the present invention will be described in detail based on the following figures, wherein.

DETAILED DESCRIPTION

Figure 1:
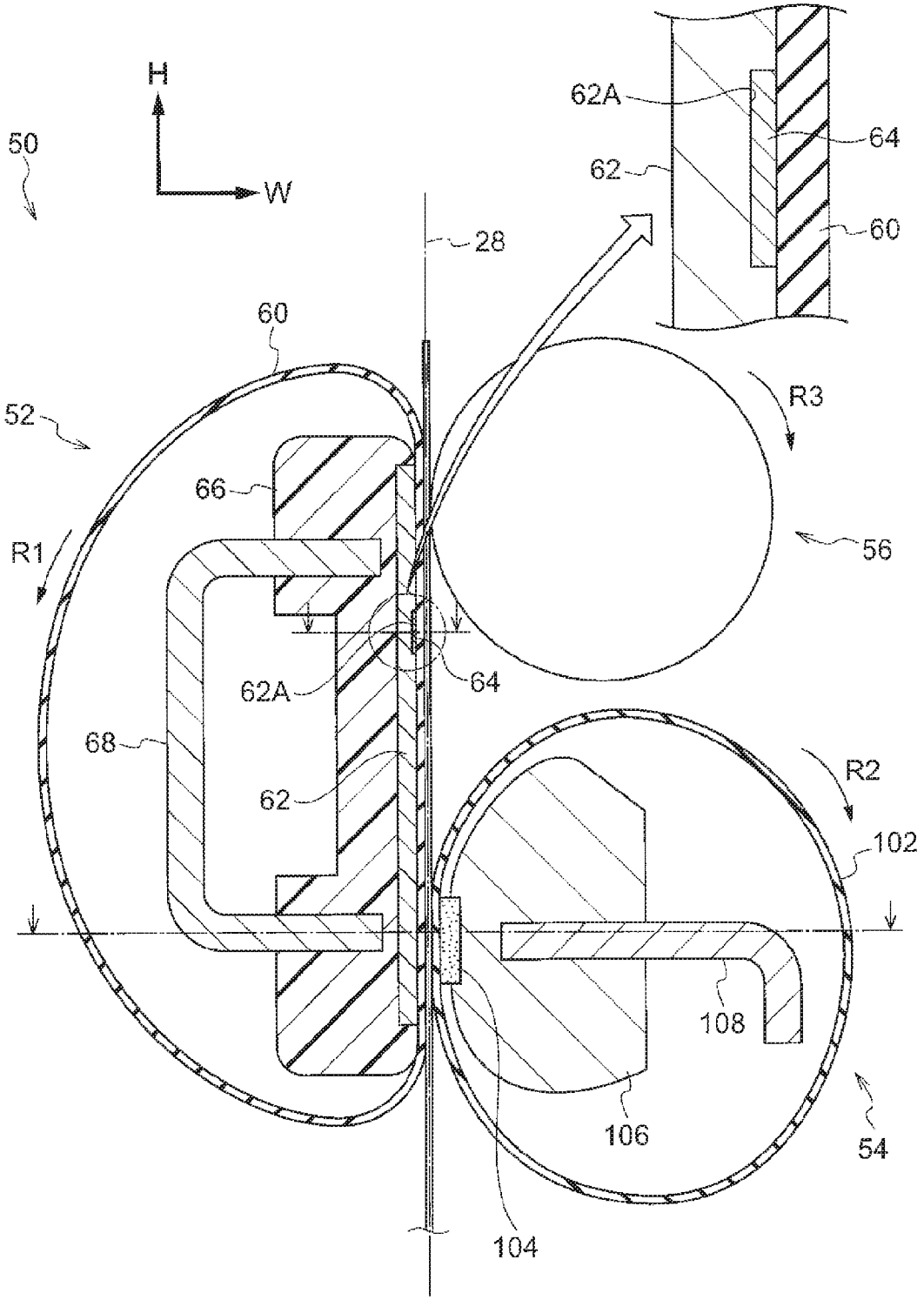
FIG. 1 is a diagram showing a fixing device according to an exemplary embodiment of the present invention.

An example of an image forming apparatus according to an exemplary embodiment of the present invention will be described below with reference to FIGS. 1 to 5. Note that, in the drawings, an arrow H shows a top-bottom direction of the apparatus (vertical direction), an arrow W shows a width direction of the apparatus (horizontal direction), and an arrow D shows a depth direction of the apparatus (horizontal direction).

Overall Configuration

Figure 5:
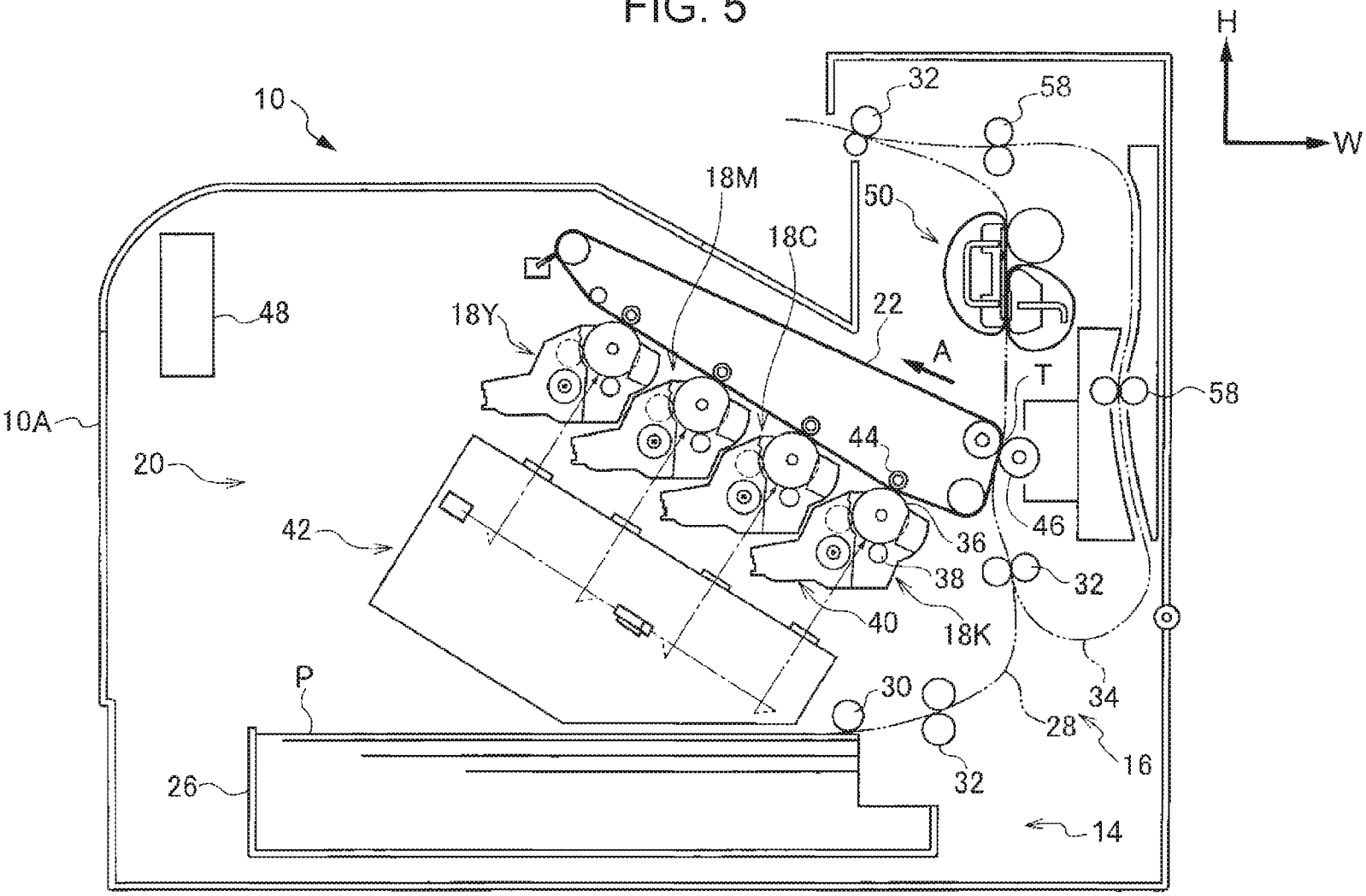
FIG. 5 is a schematic diagram showing an image forming apparatus according to the exemplary embodiment of the present invention.

As shown in FIG. 5, an image forming apparatus 10 according to this exemplary embodiment includes, in this order from the bottom to the top, in the top-bottom direction (arrow H direction): a storage section 14 that stores sheet members P, serving as recording media; a transport section 16 that transports a sheet member P stored in the storage section 14; and an image forming section 20 that forms an image on the sheet member P transported from the storage section 14 to the transport section 16. The image forming apparatus 10 also includes a controller 48 that controls the respective sections.

Storage Section

The storage section 14 includes a storage member 26 that can be pulled from an apparatus body 10A of the image forming apparatus 10 toward the near side, in the depth direction of the apparatus, and that accommodates a stack of sheet members P. The storage section 14 also includes a feed roller 30 that feeds out the sheet members P stacked in the storage member 26 to a transport path 28 that constitutes the transport section 16.

Transport Section

The transport section 16 includes multiple transport rollers 32 that transport a sheet member P along the transport path 28, along which the sheet member P fed from the storage section 14 is transported.

The transport section 16 also includes transport rollers 58 that transport a sheet member P along a reversing transport path 34, along which the sheet member P is transported when an image is to be formed on the back surface of the sheet member P that has an image formed on the front surface thereof.

Image Forming Section

The image forming section 20 includes four image forming units 18Y, 18M, 18C, and 18K corresponding to yellow (Y), magenta (M), cyan (C), and black (K). Note that, in the following description, the letters Y, M, C, and K may be omitted where these units do not need to be distinguished from one another. The image forming section 20 includes an exposure device 42 that individually irradiates image carriers 36 of the image forming units 18 with exposure light.

The image forming units 18 corresponding to the respective colors can be individually attached to and detached from the apparatus body 10A. The image forming units 18 each include the image carrier 36 and a charging member 38 that charges the surface of the image carrier 36. The image forming units 18 also each include a developing device 40 that develops an electrostatic latent image formed as a result of the exposure device 42 irradiating the charged image carrier 36 with exposure light, thus visualizing the electrostatic latent image into a toner image.

The image forming section 20 also includes an endless transfer belt 22 that is rotated in an arrow A direction in FIG. 5, and first transfer rollers 44 that transfer the toner images formed by the image forming units 18 to the transfer belt 22. The image forming section 20 also includes a second transfer roller 46 that transfers the toner images transferred to the transfer belt 22 to a sheet member P, and a fixing device 50 that applies heat and pressure to the sheet member P having the toner images transferred thereto, thereby fixing the toner images to the sheet member P.

The details of the fixing device 50 will be described below.

Operation of Image Forming Apparatus

In the image forming apparatus 10, an image is formed as follows.

First, the charging members 38 corresponding to the respective colors, which are supplied with voltage, uniformly charge the surfaces of the image carriers 36 corresponding to the respective colors to a predetermined negative electric potential. Next, the exposure device 42 irradiates the charged surfaces of the image carriers 36 with exposure light on the basis of image data received from the outside, thus forming electrostatic latent images thereon.

In this way, electrostatic latent images corresponding to the data are formed on the surfaces of the image carriers 36. Furthermore, the developing devices 40 of the corresponding colors develop these electrostatic latent images, thus visualizing them as toner images. The toner images formed on the surfaces of the image carriers 36 are then transferred to the transfer belt 22 by the first transfer rollers 44.

A sheet member P fed from the storage member 26 into the transport path 28 by the feed roller 30 is fed to a transfer position T where the transfer belt 22 and the second transfer roller 46 are in contact with each other. At the transfer position T, as a result of the sheet member P being transported between the transfer belt 22 and the second transfer roller 46, the toner images on the surface of the transfer belt 22 are transferred to the surface of the sheet member P.

The toner images transferred to the surface of the sheet member P is fixed to the sheet member P by the fixing device 50. Then, the sheet member P having the toner images fixed thereto is discharged to the outside of the apparatus body 10A.

When toner images are formed on the back surface of a sheet member P, the sheet member P having toner images fixed to the front surface thereof is fed into the reversing transport path 34 and is then fed into the transport path 28 in a reversed state. The process for forming toner images on the back surface of the sheet member P is the same as the above-described process for forming toner images on the front surface of the sheet member P.

Configuration of Relevant Part

Next, the fixing device 50 will be described.

As shown in FIG. 1, the fixing device 50 includes a heating member 52 that heats a sheet member P, and a first pressure member 54 and a second pressure member 56 that press the sheet member P toward the heating member 52.

Heating Member

The heating member 52 includes a fixing belt 60, serving as an example of a tubular member, and a heater 62, serving as an example of a heat-generating member, which is disposed inside the fixing belt 60 and heats the fixing belt 60 by receiving voltage and generating heat. The heating member 52 also includes a fuse 64, serving as an example of an interrupting member, which interrupts the voltage applied to the heater 62 when the heater 62 reaches or exceeds a threshold temperature, and a tensioning part 74 (see FIG. 2) that applies tension to the fuse 64. The heating member 52 also includes a support pad 66 that supports the heater 62, and a support frame 68 that supports the support pad 66.

Fixing Belt, Heater, Support Pad, and Support Frame

The fixing belt 60 has a tubular shape, extends in the depth direction of the apparatus (i.e., the axial direction of the fixing belt 60), and is supported so as to be able to revolve (rotate).

The heater 62 is a so-called plane heater, and it has a linear shape extending in the top-bottom direction of the apparatus, along the transport path 28, as viewed in the depth direction of the apparatus and is in contact with the inner circumferential surface of the fixing belt 60. Furthermore, the heater 62 extends in the depth direction of the apparatus and is in contact with an area between one end portion (i.e., a portion within 10% of the overall length from the corresponding end) of the fixing belt 60 and the other end portion (i.e., a portion within 10% of the overall length from the corresponding end) of the fixing belt 60. The portion of the fixing belt 60 that is in contact with the heater 62 is straight as viewed in the depth direction of the apparatus and constitutes a portion of the transport path 28. Furthermore, the heater 62 has, in the surface facing the fixing belt 60, a recess 62A extending in the depth direction of the apparatus. By receiving voltage, the heater 62 generates heat across the whole area that is in contact with the fixing belt 60 and thus heats the fixing belt 60.

The support pad 66 is made of a resin member, and it extends in the top-bottom direction of the apparatus as viewed in the depth direction of the apparatus and is in contact with the heater 62 via the surface facing the transport path 28. The support pad 66 extends in the depth direction of the apparatus and supports the heater 62 in the depth direction of the apparatus.

The support frame 68 is formed by bending a metal sheet and has a U-shaped section with the open side facing the heater 62, as viewed in the depth direction of the apparatus. Furthermore, because the ends of the support frame 68 are inserted into the support pad 66, the support frame 68 supports the support pad 66. The support frame 68 extends in the depth direction of the apparatus and supports the support pad 66 in the depth direction of the apparatus. Furthermore, the ends of the support frame 68 in the depth direction of the apparatus project from the fixing belt 60, and the projecting portions are supported by a frame member (not shown).

Fuse

Figure 2:
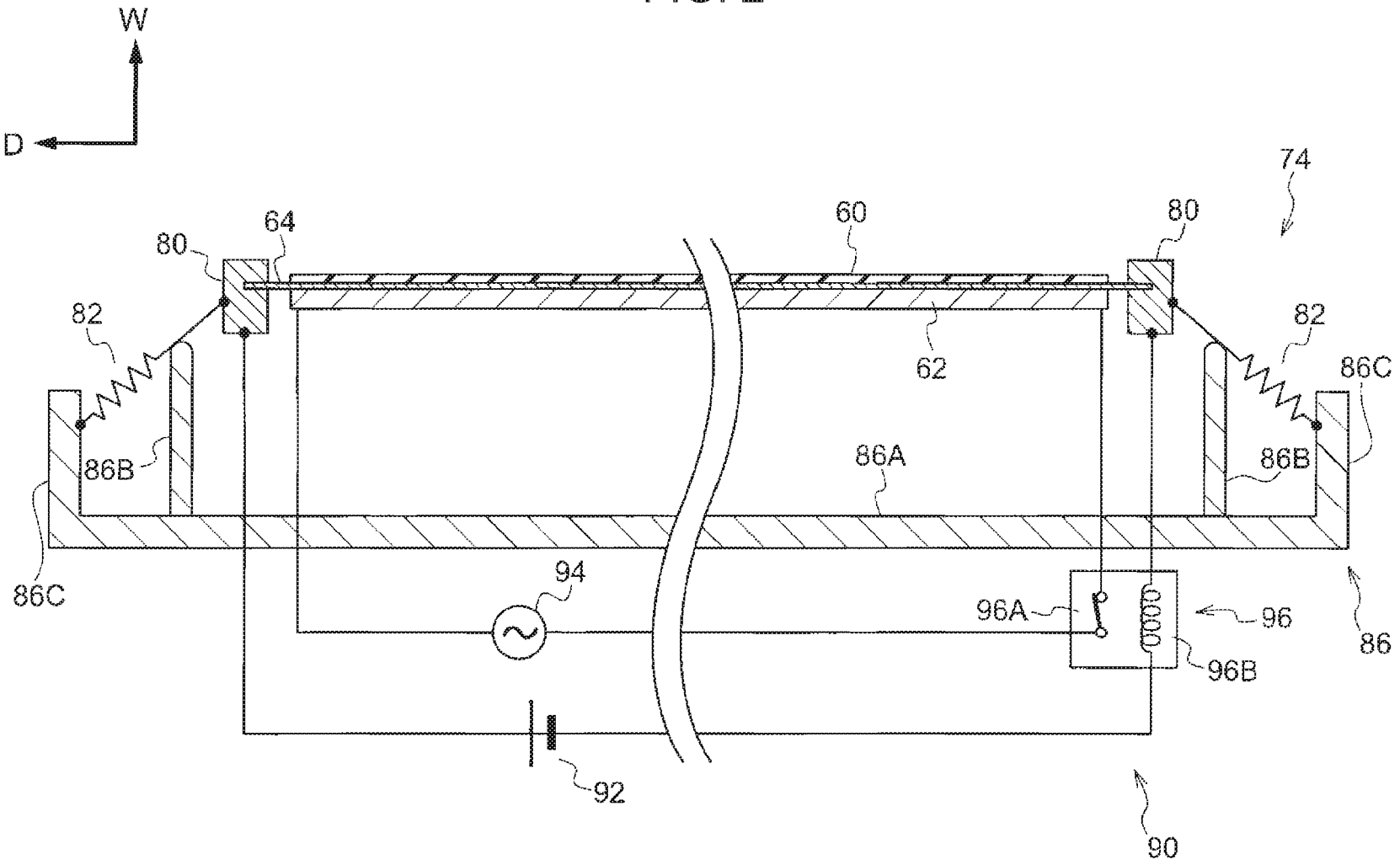
FIG. 2 is a diagram showing a fuse provided on the fixing device according to the exemplary embodiment of the present invention.

The fuse 64 is formed of copper, which is a conductor. As shown in FIGS. 1 and 2, the fuse 64 has a rectangular section and is disposed between the heater 62 and the fixing belt 60. Furthermore, the fuse 64 is fitted into a recess 62A provided in the heater 62, extends in the depth direction of the apparatus, and is in contact with an area between one end portion (i.e., a portion within 10% of the overall length from the corresponding end) and the other end portion (i.e., a portion within 10% of the overall length from the corresponding end) of the heater 62. Note that, in this exemplary embodiment, the depth of the recess 62A and the thickness of the fuse 64 are equal.

Tensioning Part

As shown in FIG. 2, the tensioning part 74 includes a pair of gripping members 80 that grip the ends of the fuse 64, a pair of tension springs 82 each having one end fixed to the gripping member 80 and the other end fixed to a support member 86, and the support member 86 that supports the tension springs 82.

The support member 86 includes a base part 86A extending in the depth direction of the apparatus, support parts 86B that support ends of the tension springs 82, and fixing parts 86C to which the other ends of the tension springs 82 are fixed.

In this configuration, the tensioning part 74 applies tension to the fuse 64. In this exemplary embodiment, when the heater 62 reaches a threshold temperature (for example, 300° C.), the fuse 64 tensioned by the tensioning part 74 blows (is ruptured).

Others

Next, an electric circuit 90 for applying voltage to the heater 62 will be described.

In the electric circuit 90, a DC power supply 92 that applies a DC voltage to the fuse 64, an AC power supply 94 that applies an AC voltage to the heater 62, and a relay 96 are disposed.

The DC power supply 92 is electrically connected to one and the other of the gripping members 80 and applies a DC voltage to the fuse 64 through the gripping members 80.

The AC power supply 94 is electrically connected a pair of terminals (not shown) provided on the heater 62 and applies an AC voltage to the heater 62 through the terminals.

The relay 96 includes a switch 96A and a coil 96B. The switch 96A is connected in series to the heater 62, and the coil 96B is connected in series to the fuse 64.

Figure 3:
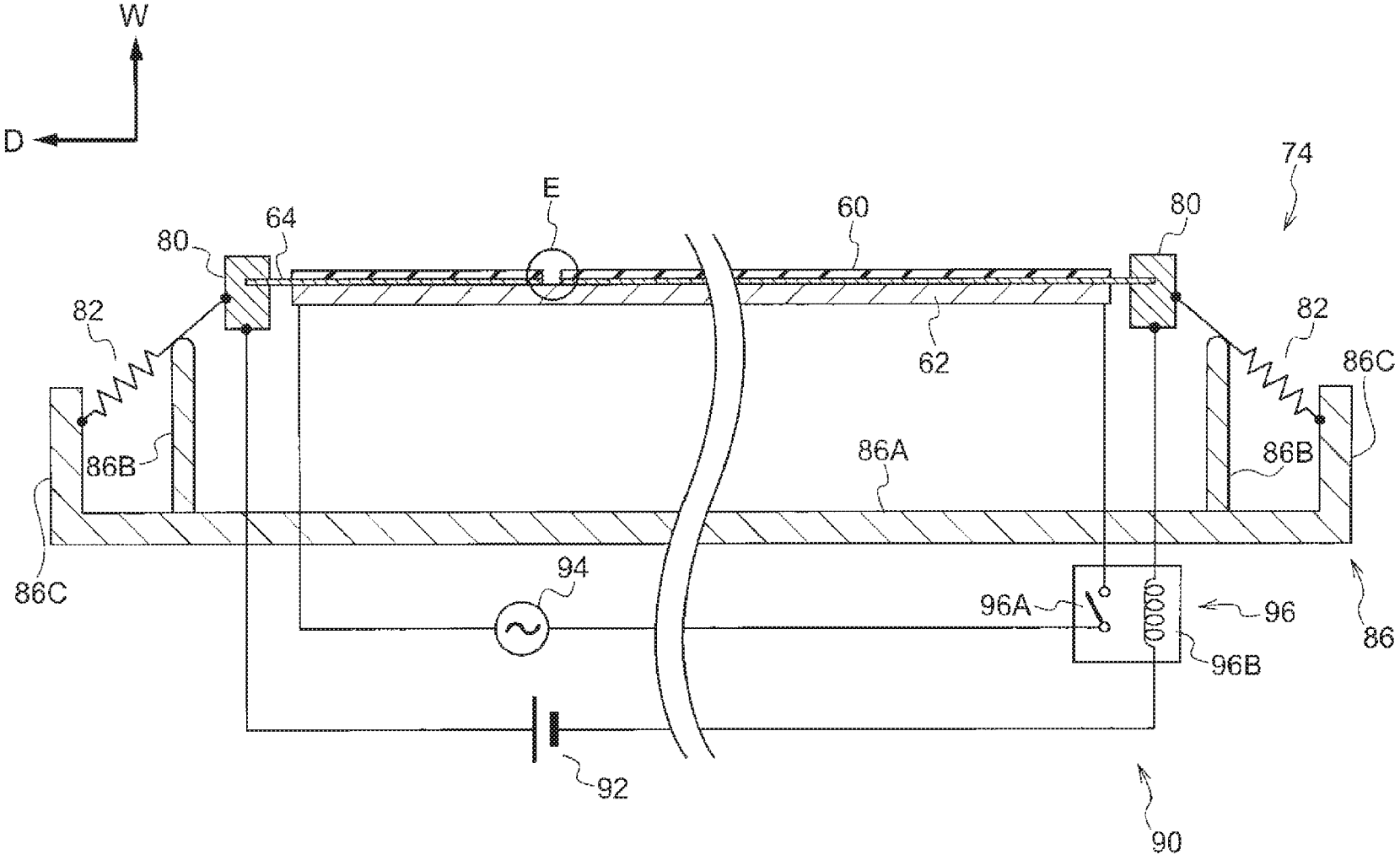
FIG. 3 is a diagram showing the fuse provided on the fixing device according to the exemplary embodiment of the present invention.

In this configuration, when a current flows through the coil 96B, the coil 96B produces a magnetic field, thus closing the switch 96A. Meanwhile, as shown in FIG. 3, when the fuse 64 blows (see part E in FIG. 3), preventing a current from flowing to the coil 96B, the magnetic field produced in the coil 96B is eliminated, thus opening the switch 96A.

First Pressure Member

As shown in FIG. 1, the first pressure member 54 is disposed so as to oppose the heating member 52 with the transport path 28 therebetween. The first pressure member 54 includes an endless pressure belt 102, a pressure pad 104 disposed inside the pressure belt 102, a support member 106 that supports the pressure pad 104, and a support frame 108 that supports the support member 106.

The pressure belt 102 has a tubular shape, extends in the depth direction of the apparatus, and is supported so as to be able to revolve (rotate). The fixing belt 60 is nipped between the pressure belt 102 and a lower end part of the heater 62.

Figure 4:
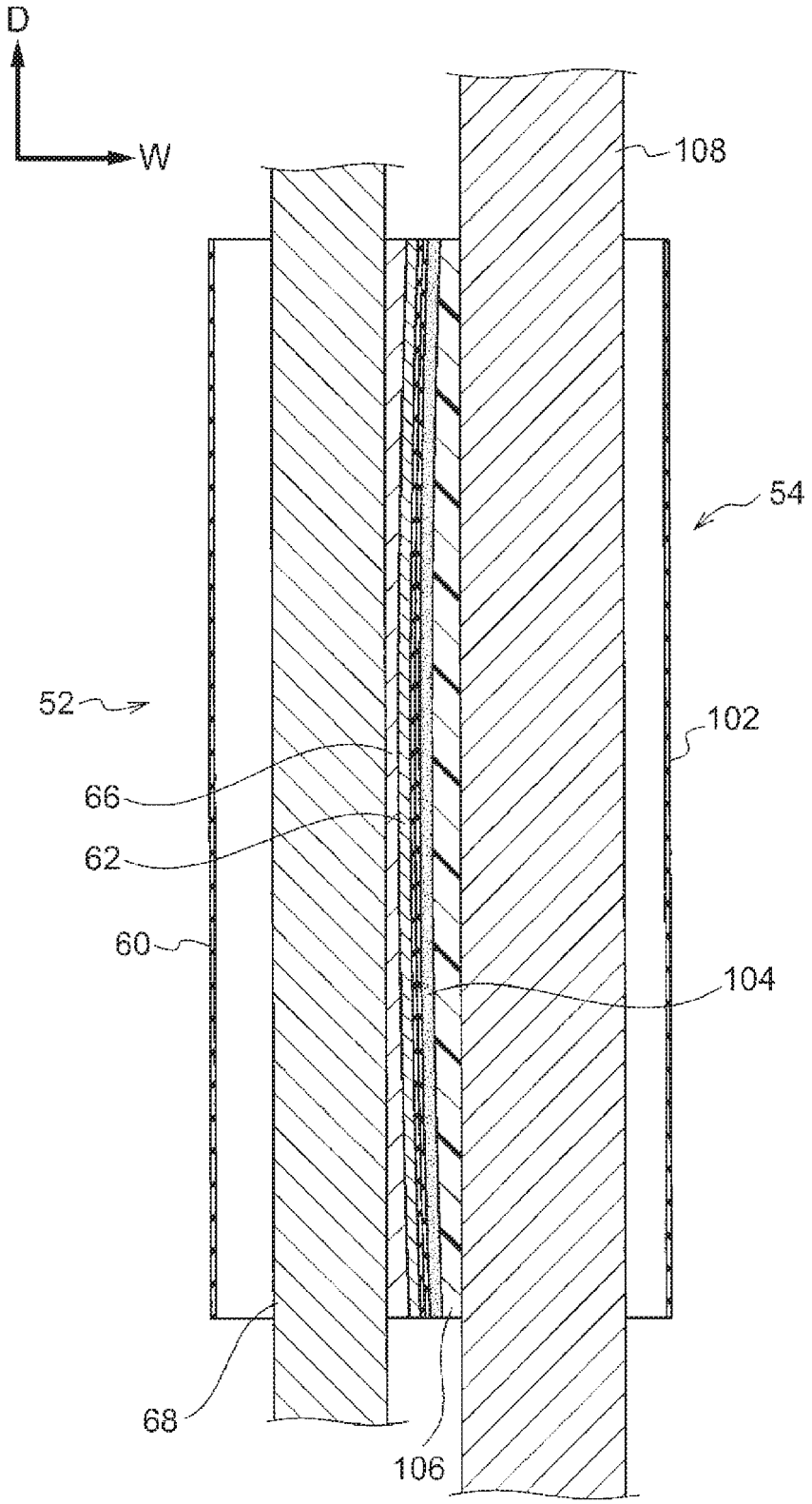
FIG. 4 is a sectional view of a first pressure member, etc. provided on the fixing device according to the exemplary embodiment of the present invention.

The pressure pad 104 is disposed so as to oppose the heater 62 with the pressure belt 102 and the fixing belt 60 therebetween. The pressure pad 104 extends in the depth direction of the apparatus and is in contact with an area between one end portion and the other end portion of the pressure belt 102. As shown in FIG. 4, the pressure pad 104 has such a curved shape (so-called crown shape) that the middle part thereof in the depth direction of the apparatus projects further toward the heater 62 than the ends, in the section perpendicular to the sheet transport direction. In other words, the pressure pad 104 has such a curved shape (so-called crown shape) that the middle part thereof in the depth direction of the apparatus projects toward the heater 62, as viewed in the sheet transport direction.

The support member 106 is formed of a resin member and, as shown in FIG. 1, is disposed so as to oppose the heater 62 with the pressure pad 104 therebetween, as viewed in the depth direction of the apparatus. The support member 106 supports the pressure pad 104 with the surface facing the heater 62. The support member 106 extends in the depth direction of the apparatus, has a curved shape (so-called crown shape) projecting toward the heater 62, similarly to the pressure pad 104, and supports the pressure pad 104 in the depth direction of the apparatus.

The support frame 108 is formed by bending a metal sheet member and has an L-shaped section as viewed in the depth direction of the apparatus. Furthermore, one end portion of the support frame 108 is inserted into the support member 106, whereby the support frame 108 supports the support member 106. The support frame 108 extends in the depth direction of the apparatus and supports the support member 106 in the depth direction of the apparatus. Furthermore, as shown in FIG. 4, both end portions of the support frame 108 in the depth direction of the apparatus project from the pressure belt 102, and the projecting parts are supported by a frame member (not shown).

In this configuration, as shown in FIG. 1, when the fixing belt 60 is rotated in a direction R1 (counterclockwise), as will be described below, the pressure belt 102 is rotated in a direction R2 (clockwise) by following the fixing belt 60.

Second Pressure Member

The second pressure member 56 has a roller shape and is disposed so as to oppose the heating member 52 with the transport path 28 therebetween. The second pressure member 56 is disposed in the transport path 28, downstream of the first pressure member 54 in the sheet transport direction. The second pressure member 56 receives a driving force from a motor (not shown) and is rotated in an arrow R3 direction (clockwise).

The second pressure member 56 and the upper end part of the heater 62 nip the fixing belt 60 therebetween. As described above, a portion of the transport path 28 between the first pressure member 54 and the second pressure member 56 is straight, as viewed in the depth direction of the apparatus.

Furthermore, the fuse 64 disposed in the recess 62A in the heater 62 is disposed in the transport path 28, between the first pressure member 54 and the second pressure member 56. In other words, the fuse 64 is disposed at a portion of the heater 62 other than the portions of the heater 62 where the fixing belt 60 is nipped between the heater 62 and the first pressure member 54 and where the fixing belt 60 is nipped between the heater 62 and the second pressure member 56.

In this configuration, when the second pressure member 56 is rotated in the direction R3 (clockwise) in FIG. 1, the fixing belt 60 is rotated in the direction R1 by following the second pressure member 56. By transporting the sheet member P from a nip part between the heating member 52 and the first pressure member 54 to a nip part between the heating member 52 and the second pressure member 56, the fixing device 50 fixes the toner image to the sheet member P.

Operation

Next, the operation of the fixing device 50 will be described. Before the fixing device 50 is actuated, the DC power supply 92 applies a DC voltage to the fuse 64, and the switch 96A is closed (see FIG. 2). Because a switcher (not shown) is in an OFF state, the application of voltage to the heater 62 by the AC power supply 94 is stopped.

When the toner image transferred to a sheet member P is fixed, a driving force is transmitted from a motor (not shown) to the second pressure member 56, and the second pressure member 56 is rotated in the direction R3, as shown in FIG. 1. As a result, the fixing belt 60 is rotated in the direction R1 by following the second pressure member 56, and the pressure belt 102 is rotated in the direction R2 by following the fixing belt 60.

Then, the switcher (not shown) is turned ON, and an AC voltage is applied to the heater 62 by the AC power supply 94 (see FIG. 2). As a result, the heater 62 generates heat and heats the rotating fixing belt 60. In this exemplary embodiment, the heater 62 heats the fixing belt 60 to 160° C.

Then, the sheet member P to be transported is nipped between the first pressure member 54 and the fixing belt 60 and is transported. The sheet member P that is nipped between the first pressure member 54 and the fixing belt 60 and is transported is then nipped between the second pressure member 56 and the fixing belt 60 and is transported. The heating member 52 heats the toner image transferred to the sheet member P at the straight portion of the transport path 28 between the first pressure member 54 and the second pressure member 56 and at the respective nip parts. In this way, the fixing device 50 fixes the toner image to the sheet member P.

As has been described above, by receiving an AC voltage, the heater 62 generates heat across the whole area that is in contact with the fixing belt 60 and heats the fixing belt 60. As described above, because the portion of the heater 62 that generates heat is in contact with the fixing belt 60, the fixing belt 60 removes heat from the heater 62. Hence, normally, the heater 62 does not reach or exceed the threshold temperature.

Next, a case where the fixing belt 60 is ruptured and separated in the depth direction of the apparatus, allowing the heater 62 to reach or exceed the threshold temperature will be described.

When the fixing belt 60 is ruptured and separated in the depth direction of the apparatus due to, for example, long-term deterioration, the heater 62 comes out of contact with the fixing belt 60 at the separated part. Because the heat is not removed by the fixing belt 60 at the part of the heater 62 that is not in contact with the fixing belt 60, the temperature of that part becomes higher than those of the other parts. Then, the part of the heater 62 that is not in contact with the fixing belt 60 reaches a temperature of 300° C.

When the part of the heater 62 that is not in contact with the fixing belt 60 reaches a temperature of 300° C., a part of the fuse 64 that is in contact with the part of the heater 62 that has reached a temperature of 300° C. blows (see part E in FIG. 3). When the fuse 64 blows, a current does not flow through the coil 96B, eliminating the magnetic field generated in the coil 96B, and thus opening the switch 96A, as shown in FIG. 3. As a result, the application of an AC voltage to the heater 62 is interrupted. In this way, the heater 62 is prevented from being heated to a temperature higher than the threshold temperature.

Also in the case where a part of the fixing belt 60 is separated from (comes out of contact with) the part of the heater 64 with which the fuse 64 is in contact, the fixing belt 60 does not remove the heat from the heater 62, and thus, the temperature of the part of the heater 62 that is not in contact with the fixing belt 60 becomes higher than those of the other parts. In this case, similarly to the case where the fixing belt 60 is ruptured, the application of an AC voltage to the heater 62 is interrupted.

CONCLUSION

As has been described above, the fuse 64 is disposed in the transport path 28, between the first pressure member 54 and the second pressure member 56. Hence, compared with a case where the fuse 64 is disposed at a portion of the heater 62 where the fixing belt 60 is nipped between the heater 62 and the first pressure member 54 or a portion of the heater 62 where the fixing belt 60 is nipped between the heater 62 and the second pressure member 56, the application of the pressure from the first pressure member 54 or the second pressure member 56 to the fuse 64 is suppressed.

Furthermore, because the application of the pressure from the first pressure member 54 or the second pressure member 56 to the fuse 64 is suppressed, the life of the fuse 64 is longer than that in the case where the pressure from the first pressure member 54 or the second pressure member 56 is applied to the fuse 64.

Furthermore, because the fuse 64 is disposed in the transport path 28, between the first pressure member 54 and the second pressure member 56, when a part of the fixing belt 60 is separated from (comes out of contact with) the heater 62 at a position between the first pressure member 54 and the second pressure member 56, the application of an AC voltage to the heater 62 is interrupted (see FIG. 3). Hence, improper fixing of the toner image to the sheet member P is suppressed.

Furthermore, as shown in FIG. 4, the pressure pad 104 has such a curved shape that the middle part thereof in the depth direction of the apparatus projects toward the heater 62, as viewed in the sheet transport direction. Hence, even when the middle part, in the depth direction of the apparatus, of the support frame 108, which is supported at the both end portions in the depth direction of the apparatus, is bent in the direction opposite to the direction of the heating member 52, the first pressure member 54 still presses the middle part of the fixing belt 60 in the depth direction of the apparatus toward the heating member 52. With this configuration, compared with a case where the part of the pressure pad 104 on the heater 62 side is straight as viewed in the sheet transport direction, separation of the fixing belt 60 from the heater 62 at the position between the first pressure member 54 and the second pressure member 56 is suppressed.

Furthermore, in the image forming apparatus 10, the life of the fixing device 50 is longer than that in the case where the fuse 64 is not provided. Hence, frequent replacement of the fixing device 50 is suppressed.

Although the present invention has been described in detail on the basis of a specific exemplary embodiment, the present invention is not limited to such an exemplary embodiment, and it is obvious to a person skilled in the art that various other exemplary embodiments are possible within the scope of the present invention. For example, in the above-described exemplary embodiment, although the heater 62 has a linear shape as viewed in the depth direction of the apparatus, it may be, for example, an arch shape.

Furthermore, in the above-described exemplary embodiment, although the pressure pad 104 has such a curved shape that the middle part thereof in the depth direction of the apparatus projects toward the heater 62 as viewed in the sheet transport direction, it does not need to have a curved shape, and it is only necessary that the middle part thereof in the depth direction of the apparatus project toward the heater 62. With this configuration, separation of the middle part of the fixing belt in the depth direction of the apparatus from the heater is suppressed. If the middle part does not project, the above-described advantage cannot be not obtained.

Furthermore, in the above-described exemplary embodiment, although the fuse 64 that blows when it reaches a high temperature is used as an example of an interrupting member that interrupts the voltage applied to the heater 62, any other member that interrupts the voltage may be used. For example, multiple compact thermostats may be arranged in the axial direction.

Furthermore, although the fixing device 50 has two pressure members in the above-described exemplary embodiment, the fixing device 50 may have one or three or more pressure members. It is only necessary that the fuse is not disposed so as to oppose the pressure member with the fixing belt therebetween.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotatable tubular member extending in an axial direction;

a heat-generating member extending in the axial direction and contacting an area between one end portion and another end portion of the tubular member, the heat-generating member being configured to generate heat to heat the tubular member by receiving voltage;

a pressure member that nips the tubular member between the pressure member and a portion of the heat-generating member, wherein the pressure member is configured to press to an outer circumferential surface of the tubular member, a recording medium having a toner image transferred thereto; and an interrupting member disposed between another portion of the heat-generating member and the tubular member and extending in the axial direction, wherein the interrupting member contacts an area between one end portion and another end portion of the heat-generating member, wherein the interrupting member is configured to interrupt the voltage applied to the heat-generating member when at least a portion of the interrupting member contacting the heat-generating member in the axial direction reaches or exceeds a threshold temperature, and wherein the interrupting member contacts the tubular member.

2. The fixing device according to claim 1, wherein the pressure member includes a first pressure member and a second pressure member that is disposed downstream of the first pressure member, in a recording-medium transport direction, in a recording-medium transport path, and wherein the interrupting member is disposed between the first pressure member and the second pressure member in the recording-medium transport path.

3. The fixing device according to claim 2, wherein the first pressure member is supported by an apparatus body at both end portions thereof in the axial direction, and a middle part of the first pressure member in the axial direction projects toward the heat-generating member, as viewed in the recording-medium transport direction.

4. An image forming apparatus comprising:

a forming part configured to form a toner image;

a transfer part configured to transfer the toner image formed by the forming part to a recording medium; and the fixing device according to claim 3, the fixing device being configured to fix the toner image transferred to the recording medium by the transfer part to the recording medium.

5. An image forming apparatus comprising:

a forming part configured to form a toner image;

a transfer part configured to transfer the toner image formed by the forming part to a recording medium; and the fixing device according to claim 2, the fixing device being configured to fix the toner image transferred to the recording medium by the transfer part to the recording medium.

6. An image forming apparatus comprising:

a forming part configured to form a toner image;

a transfer part configured to transfer the toner image formed by the forming part to a recording medium; and the fixing device according to claim 1, the fixing device being configured to fix the toner image transferred to the recording medium by the transfer part to the recording medium.

7. The fixing device according to claim 1, wherein the interrupting member contacts an entire area extending between the one end portion and the another end portion of the heat-generating member.

8. The fixing device according to claim 1, wherein all parts of the heat-generating member are configured to generate heat.

9. The fixing device according to claim 1, wherein the heat-generating member is a heater.

10. The fixing device according to claim 1, wherein the heat-generating member comprises a plane heater.

11. The fixing device according to claim 1, wherein the heat-generating member has a linear shape.

* * * * *